US009241560B1

(12) United States Patent
Angel

(10) Patent No.: US 9,241,560 B1
(45) Date of Patent: Jan. 26, 2016

(54) FLOW THRU TELESCOPING HANDLE AND METHOD

(71) Applicant: Bruce A. Angel, Stokesdale, NC (US)

(72) Inventor: Bruce A. Angel, Stokesdale, NC (US)

(73) Assignee: Camco Manufacturing, Inc., Greensboro, NC (US)

( * ) Notice: Subject to any disclaimer, the term of this patent is extended or adjusted under 35 U.S.C. 154(b) by 203 days.

(21) Appl. No.: 14/074,828

(22) Filed: Nov. 8, 2013

(51) Int. Cl.
*A46B 11/06* (2006.01)
*A46B 17/02* (2006.01)

(52) U.S. Cl.
CPC ..... *A46B 11/063* (2013.01); *A46B 17/02* (2013.01)

(58) Field of Classification Search
CPC ..... A46B 11/063; A46B 2200/3046; B60S 3/045; B60S 3/047
USPC ..... 401/289; 239/281
See application file for complete search history.

(56) References Cited

U.S. PATENT DOCUMENTS

| | | | | |
|---|---|---|---|---|
| 226,551 | A | 4/1880 | Randolph | 403/3 |
| 919,610 | A | 4/1909 | Maeder | 15/144.1 |
| 1,871,146 | A | 8/1932 | Bosler | 403/55 |
| 2,013,963 | A | 9/1935 | Ingling | 403/93 |
| 3,362,037 | A | 1/1968 | Griffin | 15/229.6 |
| 4,893,370 | A | 1/1990 | Klotz | 15/121 |
| 5,336,012 | A * | 8/1994 | Newville | 401/289 |
| 5,400,457 | A | 3/1995 | Ridgley | 15/167.1 |
| 5,487,529 | A * | 1/1996 | Newville | 251/148 |
| 5,515,574 | A | 5/1996 | Larson | 16/115 |
| 5,661,868 | A | 9/1997 | Panagakos et al. | 15/184 |
| 5,729,865 | A * | 3/1998 | Stoddart | 16/429 |
| 6,213,672 | B1 | 4/2001 | Varga | 403/109.2 |
| 6,256,829 | B1 | 7/2001 | Hatch et al. | 15/144.4 |
| 6,546,596 | B2 * | 4/2003 | Grote et al. | 16/429 |
| 6,709,529 | B1 | 3/2004 | Mekwinski | 134/6 |
| 6,760,949 | B2 | 7/2004 | Kaminstein et al. | 15/164 |
| 6,854,916 | B2 | 2/2005 | Hsieh | 403/109.3 |
| 6,883,264 | B1 | 4/2005 | Gimbel | 43/6 |
| 7,055,204 | B2 | 6/2006 | Ajluni | 15/121 |
| 7,600,287 | B1 | 10/2009 | Moore et al. | 15/144.4 |
| 7,743,458 | B1 | 6/2010 | Moore et al. | 15/257.2 |
| 7,921,505 | B1 | 4/2011 | Moore et al. | 15/257.2 |
| 8,100,446 | B1 | 1/2012 | Moore et al. | 294/1.4 |
| D670,150 | S | 11/2012 | Angel et al. | D8/107 |
| D670,151 | S | 11/2012 | Angel et al. | D8/107 |
| 8,469,423 | B1 | 6/2013 | Crowley, Jr. et al. | 294/174 |
| 2005/0071943 | A1 | 4/2005 | Liu | 15/257.2 |
| 2005/0235446 | A1 | 10/2005 | Eggers | 15/220.1 |
| 2005/0283933 | A1 | 12/2005 | Mitchell et al. | 15/144.1 |
| 2006/0123575 | A1 | 6/2006 | Maloney et al. | 15/144.1 |

* cited by examiner

*Primary Examiner* — Jennifer C Chiang
(74) *Attorney, Agent, or Firm* — Blake P. Hurt; Tuggle Duggins P.A.

(57) ABSTRACT

A flow thru telescoping handle for use with brush heads and other tools includes a telescoping handle having a tear-drop shaped cross section to increase the strength and improve its functioning capabilities. A spring loaded tension pin is mounted along the bottom of the outer section of the handle which is operated by finger pressure to engage and release it from the inner handle section. A method for adjusting the length of the telescoping handle is also described using the tension pin.

20 Claims, 4 Drawing Sheets

FLOW THRU TELESCOPING HANDLE AND METHOD

FIELD OF THE INVENTION

The invention herein pertains to a telescoping handle and particularly pertains to a flow thru telescoping handle for supplying water to an attached brush head or other tool. A tension finger pin allows the handle to telescope as needed.

DESCRIPTION OF THE PRIOR ART AND OBJECTIVES OF THE INVENTION

Telescoping handles have long been used in various applications to increase the reach and convenience of certain tools. Brush heads, scrapers, squeegees and the like often employ telescoping handles for adjustable use and assistance to the user. Telescoping handles are also used to provide water to brushes for cleaning purposes and oftentimes keep the user from needing a ladder or other device when a remote or high area is being cleaned. Some adjustable or extendable handles are difficult and time consuming to adjust. Other telescoping handles tend to leak and can cause accidents if they become ungrippable. Some telescoping handles require the user to stop and use two hands to operate the handle adjustment mechanism.

Thus, in view of the problems and disadvantages associated with prior art telescoping devices, the present invention was conceived and one of its objectives is to provide a flow thru telescoping handle having a simple, easy to use adjustment mechanism which can be operated with one hand.

It is another objective of the present invention to provide a telescoping handle with a series of notches for accurately, consistently indexing the length of the handle.

It is still another objective of the present invention to provide a water supplied telescoping handle which is relatively simple in construction yet is durable and reliable.

It is yet another objective of the present invention to provide a telescoping handle which is relatively light-in-weight and can be manufactured and sold at a low cost.

It is a further objective of the present invention to provide a flow thru telescoping handle which can be used with a variety of liquid solutions and tools or instruments depending on the particular needs of the user.

It is still a further objective of the present invention to provide a telescoping handle which is formed with a tear-drop cross section for strength, functionality and stability.

Various other objectives and advantages of the present invention will become apparent to those skilled in the art as a more detailed description is set forth below.

SUMMARY OF THE INVENTION

The aforesaid and other objectives are realized by providing a method and apparatus having a flow thru telescoping handle with elongated inner and outer sections. The inner section is slideably received within the outer section and gaskets are utilized to prevent handle leakage. Water is supplied through a water hose connected at the distal end of the outer section and travels therethrough and on through a brush or other implement attached to the proximal end of the inner section on the opposing end. The handle can be easily adjusted (lengthened) by a spring loaded tension pin using finger pressure which allows a user to index the length of the handle through a series of notches positioned along the bottom of the inner section. While a brush head is shown used with the telescoping handle other suitable tools may be attached as necessary in substitution of the brush head.

DETAILED DESCRIPTION OF THE PREFERRED EMBODIMENT AND OPERATION OF THE INVENTION

Figure 1:
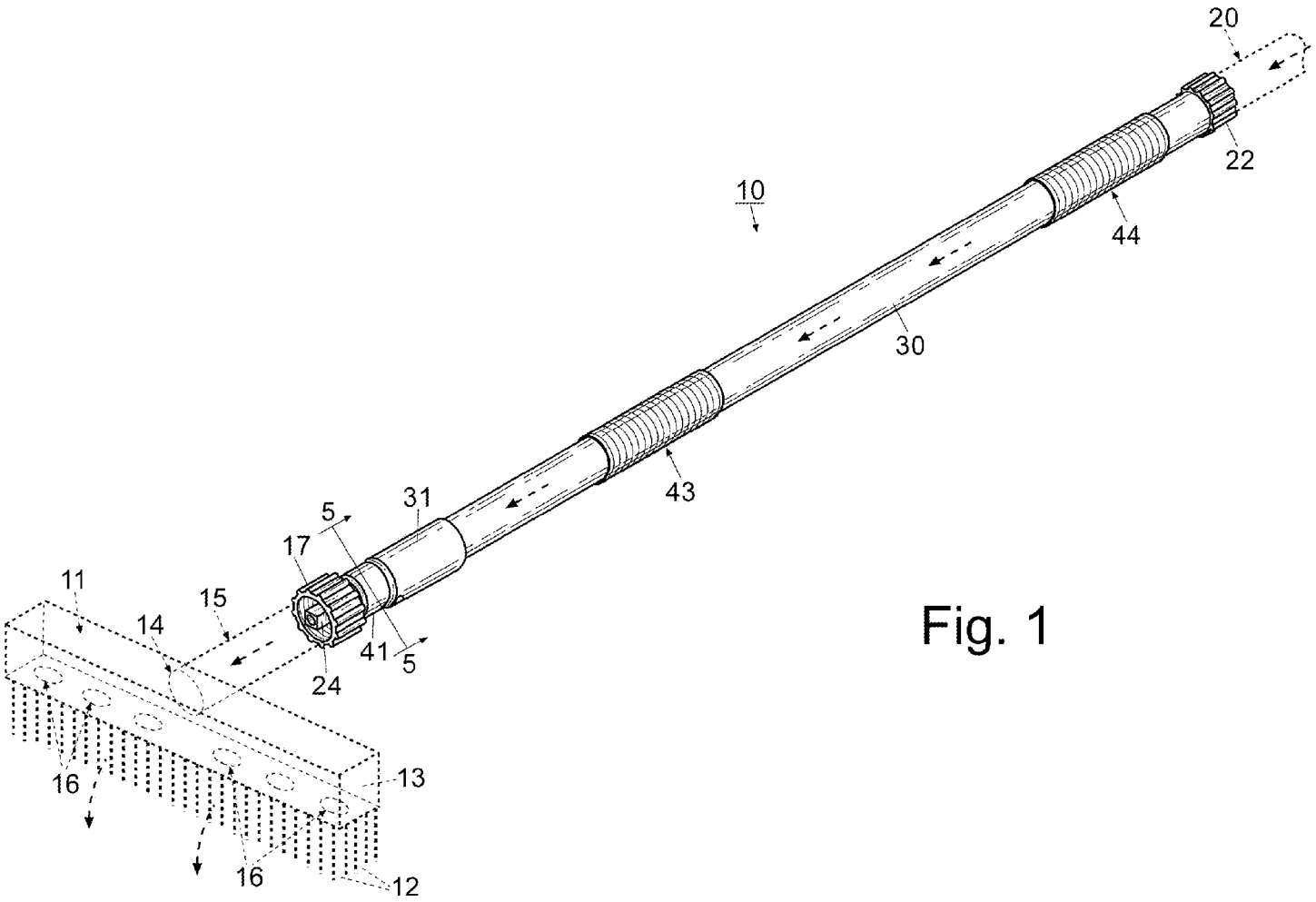
FIG. 1 shows the telescoping handle of the invention as affixed to a water supply hose and a brush head, both shown in dotted line fashion.

For a better understanding of the invention and its operation, turning now to the drawings, FIG. 1 illustrates preferred flow thru telescoping handle 10 in a fully closed posture as connected to conventional water hose 20 on the distal end as shown in dotted line fashion and joined to brush head 11, also shown in dotted line fashion on the opposing proximal end. As would be understood, handle 10 can be manually extended as desired.

Figure 2:
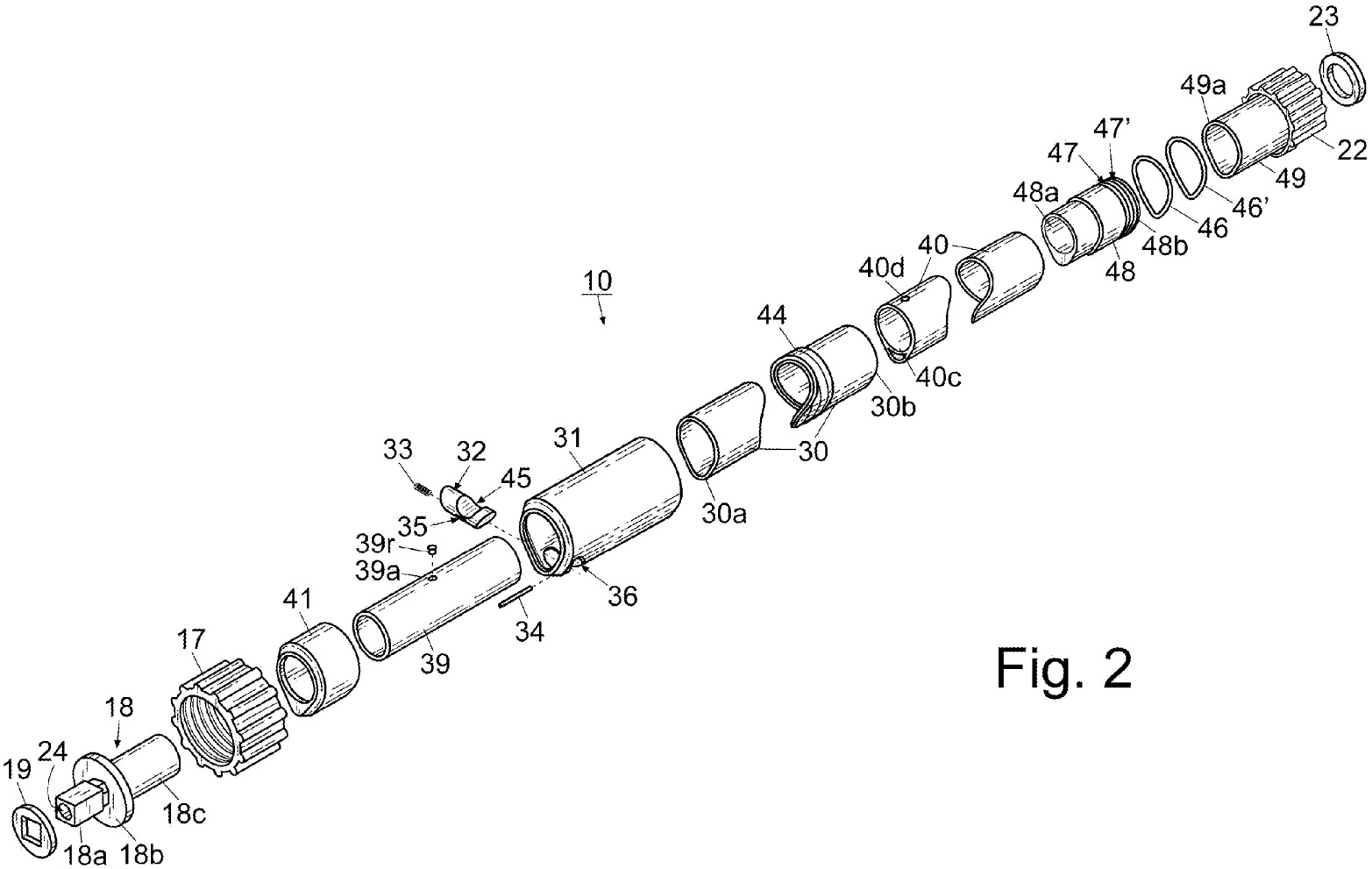
FIG. 2 pictures an exploded, fragmented view of the telescoping handle with the brush head and water hose removed.

Handle 10 is shown exploded in FIG. 2 in fragmented fashion having the following components: washer 19, stop connector 18 having square nozzle 18*a* with outlet 24, circular stop 18*b* and conduit 18*c*, threaded nut 17, inner section bushing 41, tubular connector 39 having aperture 39*a* for reception of rivet 39*r*, elongated bushing 31 having tension pin channel 36, tension pin 32 having dowel tunnel 35 and depression 45, tension pin spring 33, tension pin dowel 34, outer section 30 having grips 43, 44 (FIG. 1), inner section 40 having aperture 40*d* on one end and bushing 48 with gasket grooves 47, 47' on the other end with notches 42 (FIG. 4), gaskets 46, 46', hose connection tube 49 with water hose fitting 22 and water hose gasket 23.

Brush head 11 includes head pipe 15 with opening 14 formed therein, base 13 including apertures 16 and bristles 12 joined thereto. Head pipe 15 is connected to base 13 such that opening 14 is in communication with apertures 16 to allow fluids and the like to pass therethrough and out, over and through bristles 12. Head pipe 15 threadably connects to threaded nut 17 for assembly on telescoping handle 10 whereas threaded fitting 22 on the opposing distal end connects to the threaded end (not seen) of standard water hose 20.

As would be understood, water hose 20 supplies water, a soap solution, or other liquid for passage through handle 10 and through outlet 24 of stop connector 18 as shown in FIG. 2. The water then flows through outlet 24 and head pipe 15 to head opening 14 and into brush base 13. Water then passes through apertures 16 as shown in FIG. 1 to allow water flow out, along and through bristles 12. The flow rate or water pressure can be adjusted by a conventional faucet handle or other standard valve (not shown). Grips 43, 44 as shown in FIG. 1 allow a user to frictionally hold telescoping handle 10 securely while washing or rinsing with brush head 11.

As seen in FIG. 2, washer 19 is circular having a central square opening therein and is slideably received on square nozzle 18*a*. Washer 19 is made from a polymeric material and when brush head 11 is connected to handle 10 acts in connection with circular stop 18*b* of stop connector 18 to form a watertight seal between head pipe 15 and nut 17.

Stop connector 18 is preferably formed from a rigid plastic such as acrylonitrile butadiene styrene (ABS) with square nozzle 18*a* on one end and conduit 18*c* on the opposing end having circular stop 18*b* therebetween. Stop connector 18 includes channel or outlet 24 formed therein to allow fluid passage therethrough. Although not shown, but as would be understood, nut 17 includes a central opening sized to receive conduit 18*c* therethrough whereby circular stop 18*b* abuts the innermost edge of nut 17 to prevent further insertion of stop connector 18 thus providing a water tight seal when nut 17 is affixed to pipe 15 of brush head 11. Nut 17 includes ridges therearound on the outside surface for ease in grasping and rotating when being tightened or loosened.

Inner section bushing 41 as seen in FIG. 2 is preferably formed having an outer tear-drop shape from ABS or other suitable plastic though a metal such as aluminum may be used. The proximal end is tapered and includes a circular opening for accommodation and reception of conduit 18*c* to abut nut 17. The opposing distal end includes a complimentary tear-drop shaped opening formed therein for accommodation and insertion of tubular connector 39 and inner section 40 as described in more detail below.

Tubular connector 39 is preferably formed from aluminum tubing and includes aperture 39*a* for reception of rivet 39*r*. Rivet 39*r* is preferably aluminum and 3 mm with a grip range to accommodate 3.2 mm. Tubular connector 39 has a cylindrical cross-section and is received within inner section 40 and affixed thereto by rivet 39*r*.

Figure 5B:
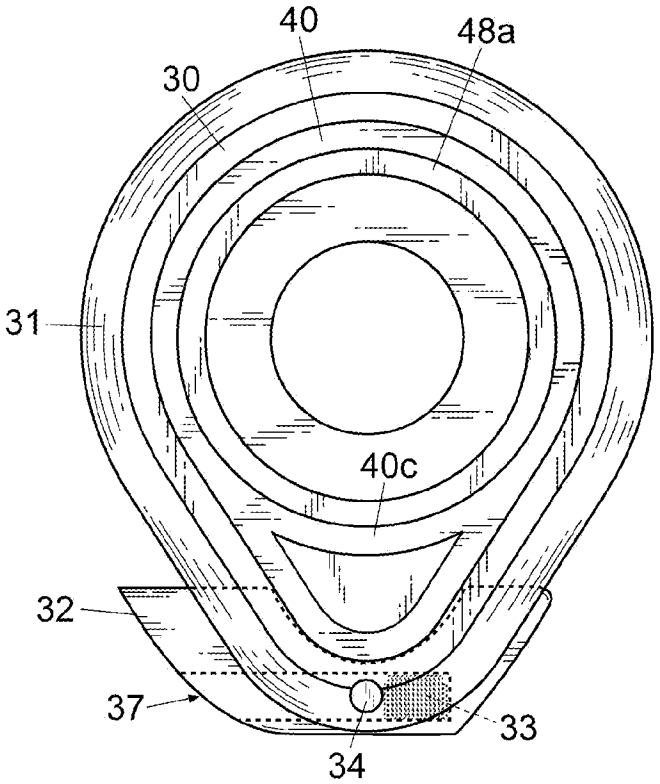
FIG. 5B features a cross sectional view of the telescoping handle as shown in FIG. 5A but with the tension pin in an open or unlocked position.
Figure 5A:
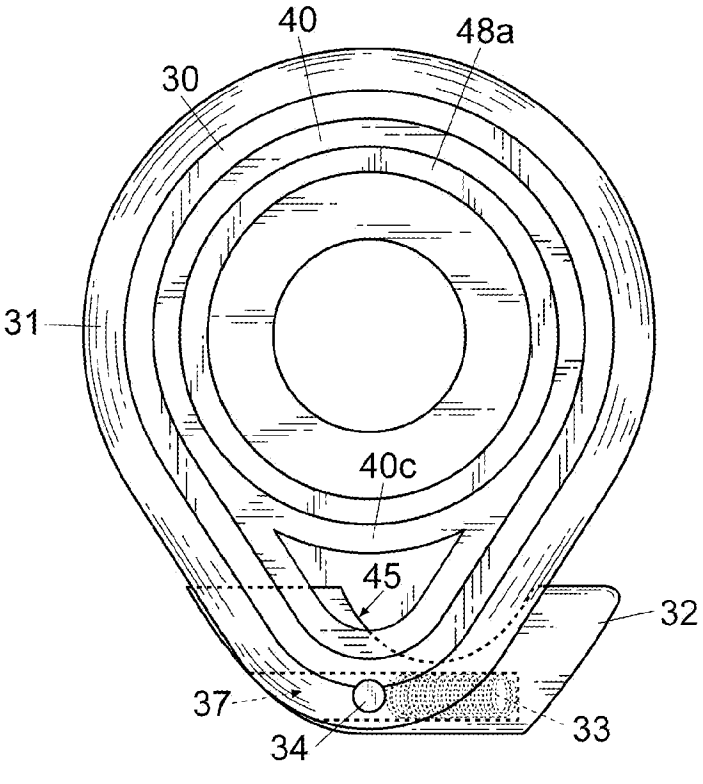
FIG. 5A illustrates a cross sectional view of the telescoping handle as along lines 5-5 of FIG. 1 with the tension pin in a closed or locked position.

Elongated bushing 31 is preferably formed from ABS or other suitable plastic in a tear-drop shape with an opening therethrough for reception and accommodation of tear-drop shaped outer section 30. Elongated bushing 31 includes on the proximal end a tapered outer edge and dowel port 38 (FIG. 3) for reception of tension pin dowel 34. Elongated bushing 31 further includes tubular tension pin channel 36 formed in the proximal end at the bottom of the tear-drop shape as seen in FIGS. 5A and 5B for reception of tension pin 32 therethrough.

Figure 3:
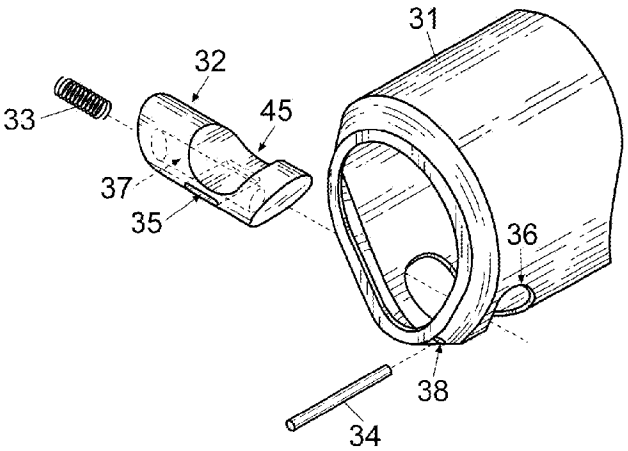
FIG. 3 depicts an enlarged, partial view of the elongated bushing as seen in FIG. 2 with the tension pin, tension pin spring and tension pin dowel exploded therefrom.

Tension pin 32 as shown enlarged in FIG. 3 is preferably formed from ABS or other suitable plastic and includes tension pin spring 33 which slides within cylindrical spring channel 37 (seen in dotted line format). Spring channel 37 is formed in one side and does not extend completely through the other side of tension pin 32 as also shown in FIGS. 5A and 5B. Tension pin 32 is cylindrical or tubular in shape and includes a tapered end on one side for ease in finger manipulation and a rounded, tapered end proximate spring channel 37. Tension pin 32 also includes dowel tunnel 35 which is a slim rectangular tunnel having rounded ends formed in opposing relation to depression 45 and intersects spring channel 37. Dowel tunnel 35 goes completely through tension pin 32 and is sized to receive tension pin dowel 34. Depression 45 as seen in FIGS. 5A and 5B conforms to the outer configuration of the bottom outer surface of tear-drop shaped inner section 40 to either lock handle 10 in place when tension pin 32 engages one of notches 42 (FIG. 4) or to unlock handle 10 for moving inner section 40 within outer section 30 for either extending or collapsing handle 10 respectfully. As would be understood when assembled, tension pin dowel 34 is placed within dowel port 38 and dowel tunnel 35 and limits the side-to-side movement of tension pin 32 when manipulated.

Outer section 30 and inner section 40 are both preferably seamlessly formed from an aluminum alloy but may be formed from other suitable metals, plastics, or other desirable materials. Outer section 30 is formed in a tear-drop shape having a channel formed therethrough for passage of water and other fluids and for slideably receiving inner section 40 therein. Outer section 30 includes proximal end 30*a* and distal end 30*b* and as shown in FIGS. 5A and 5B is slightly larger than inner section 40 for slidable reception thereover. Outer section 30 further includes polymeric hand grips 43, 44 for easy grasping of telescoping handle 10 when in use.

Figure 4:
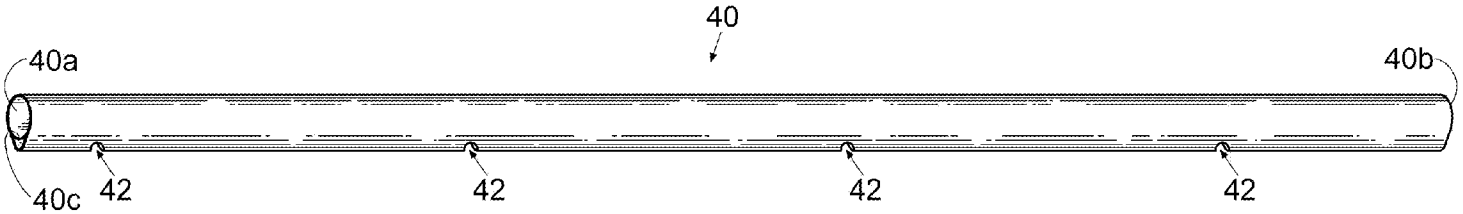
FIG. 4 demonstrates a perspective side view of the tear-drop shaped inner section showing the notches in the bottom thereof as used for indexing or length adjustment of the telescoping handle.

Inner section 40 is likewise formed in a tear-drop shape however includes an inner, arcuate wall 40*c* proximate the tear-drop shape extending the full length of inner section 40 and from side to side to form a cylindrical channel therethrough for passage of water and other fluids. Within the lower, hollow tear-drop shape of inner section 40 below arcuate wall 40*c*, notches 42 are formed from side to side therethrough for reception of tension pin 32. As seen in FIG. 4 a plurality of notches 42 are formed therein and spaced apart to allow for varying extension lengths of inner section 40 within outer section 30. Preferably, four notches 42 are used although more or less notches may be employed. As would be understood the cylindrical channel formed in inner section 40 maintains the fluid or other liquid therein and prevents leakage through notches 42 as would occur if arcuate wall 40*c* were not formed therein. Inner section 40 includes proximal end 40*a* and distal end 40*b* as seen in FIG. 4 and slideably fits within and has an outer diameter slightly less than the inner diameter of outer section 30 to allow easily sliding (lengthening or shortening) for a desired extension of handle 10. Aperture 40*d* is formed in the upper, arcuate top of outer section 40 near or at proximal end 40*a*.

Bushing 48 on inner section 40, is preferably formed from ABS or other suitable plastic having a cylindrical channel formed therein. Bushing 48 includes a cylindrical proximal end 48*a* on one end and tear-drop shaped distal end 48*b* having grooves 47, 47' formed therein for receiving standard O-ring type gaskets 46, 46' having a tear-drop shape. Gaskets 46, 46' are formed from a suitable polymeric material to prevent water leakage between inner section 40 and outer section 30. Bushing proximal end 48*a* has an outer cylindrical diameter slightly less than the inner cylindrical diameter of inner section 40 for insertion therein. As would be understood, the inner edge of tear-drop shaped distal end 48*b* of bushing 48 abuts distal end 40*b* of inner section 40 when inserted, sealing distal end 40*b*.

Hose connection tube 49 is preferably formed from ABS or other suitable plastic having tear-drop shaped proximal end 49*a* and tubular water hose fitting end 22 formed on the opposing distal end thereof for accepting the threaded end of a water hose such as hose 20. Hose connection tube 49 includes an opening therethrough for the passage of water or other liquids. Water hose fitting end 22 is internally threaded and includes ridges therearound on the outside surface for ease in grasping and rotating when tightening or loosening hose 20 thereto. Tear-drop shaped proximal end 49*a* has an outer diameter slightly less than the inner diameter of outer section 30 to fit within distal end 30*b* and to maintain a watertight seal therebetween. Water hose gasket 23 is conventional and inserted within water hose fitting 22 to maintain a watertight seal between water hose 20 and tube 49.

For assembly of telescoping handle 10, proximal end 48*a* of bushing 48 is affixed by epoxy or other suitable adhesive within inner section 40 and gaskets 46, 46' (FIG. 2) are placed within grooves 47, 47' respectively. Hand grips 43, 44 are each slid over distal end 30*b* and positioned on outer section 30 as seen in FIG. 1. Thereafter, elongated bushing 31 is pressed onto proximal end 30*a* of outer section 30 whereby tension pin 32 is positioned within tension pin channel 36. Tension pin spring 33 is then positioned within spring channel 37 as seen in FIG. 3 and compressed such that tension pin dowel 34 can be inserted through dowel port 38 of bushing 31 and into dowel tunnel 35 of tension pin 32 to retain tension pin spring 33 between tension pin dowel 34 and the closed end of spring channel 37 as seen in FIGS. 5A and 5B.

Suitable lubrication is required on gaskets 46, 46' and thereafter inner section 40 can be slideably inserted within outer section 30. Tubular connector 39 is then affixed by epoxy or other suitable adhesive to inner section 40 and riveted thereto by rivet 39*r* which is received within aperture 40*d* of inner section 40 and aperture 39*a* of tubular connector 39. Inner section bushing 41 is then pressed over tubular connector 39 and onto proximal end 40*a* of inner section 40. Next, nut 17 is positioned on tubular connector 39 and conduit 18*c* of stop connector 18 is inserted within tubular connector 39 and affixed thereto with epoxy or other desirable adhesive. Washer 19 is then positioned over square nozzle 18*a*. Thereafter proximal end 49*a* of hose connection tube 49 is inserted within distal end 30*b* of outer section 30 and affixed thereto such as by epoxy or other proper adhesive. Water hose gasket 23 is then positioned within water hose fitting 22 to complete assembly of flow thru telescoping handle 10. As would be understood when assembled, the tapered ends and various channels within the components of handle 10 allow for a watertight channel from end to end therein for passage of fluids therethrough when in use whether handle 10 is collapsed or extended. When in use, brush head 11 (FIG. 1) is affixed to inner section 40 whereas water hose fitting 22 is affixed to outer section 30 such that proximal end 30*a* of outer section 30 slides rearwardly towards distal end 40*b* of inner section 40 when telescoping handle 10 is extended.

In order to release outer section 30 from inner section 40 for telescoping handle adjustment, tension pin 32 is pressed from a right position as shown in FIG. 5A to a left position until it is placed as shown in FIG. 5B. In FIG. 5A tension pin 32 is in a closed posture to lock inner section 40 in place and prevent relative movement between outer section 30 and inner section 40. Here, tension pin spring 33 is relaxed and abuts tension pin dowel 34. In FIG. 5B, tension pin spring 33 is shown in a compressed posture as it rests between the end of spring channel 37 and tension pin dowel 34.

Tension pin dowel 34 is preferably formed from a desired metal or plastic and is inserted through dowel port 38 in elongated bushing 31 as shown in FIG. 3. Tension pin dowel 34 passes through dowel tunnel 35 in tension pin 32 which allows tension pin 32 to move back and forth thereon as for example shown in FIGS. 5A and 5B. Tension pin channel 36 also shown in FIG. 3 allows for lateral movement of tension pin 32 when extending or contracting telescoping handle 10.

In the method of use, tension pin 32 is moved from a locked position (FIG. 5A) by applying finger pressure to the closed end thus compressing spring 33 (FIG. 5B) to permit outer section 30 to be slid along inner section 40. As such during sliding when tension pin 32 reaches the nearest notch 42 it will slide therethrough by decompression of spring 33 forcing tension pin 32 into a locked position. Tension pin 32 can be held in place by finger pressure during sliding to seat within a selected notch 42 of inner section 40, as inner section 40 and outer section 30 are slid, relative to each other. When so seated, with the release of tension pin 32, telescoping handle 10 is then secured at another specific length.

Telescoping handle 10 is first assembled as previously described and thereafter, tension pin 32 engages a specific notch along the bottom of inner section 40. Thereafter, if handle 10 requires length adjustment, finger pressure is applied to tension pin 32 and it is urged from a locked position as shown in FIG. 5A to an unlocked or open position as shown in FIG. 5B. In this position depression 45 of tension pin 32 aligns with the outer tear-drop shaped surface of inner section 40. Thereafter, inner section 40 and outer section 30 are moved relative to each other to a desired length at a selected notch, with tension pin spring 33 thus urging tension pin 32 into a closed position as shown in FIG. 5A within a desired notch 42. Thereafter, telescoping handle 10 can be used for example as a brush handle or otherwise. After use tension pin 32 can be urged into its open position as shown in FIG. 5B for extending the handle further or collapsing the handle to its shortest most position whereby brush head 11 and water hose 20 are removed for storage or transportation purposes.

The illustrations and examples provided herein are for explanatory purposes and are not intended to limit the scope of the appended claims.

I claim:

1. A telescoping handle comprising: an inner section, an outer section, said outer section defining a proximal end and a distal end, said inner section slideably received in said outer section, a tension pin, said tension pin mounted proximate said proximal end and contacting said inner section, a dowel, said dowel engaging said tension pin, said tension pin selectively slidable along said dowel from a locked position to an unlocked position to allow telescoping adjustment of the handle.

2. The telescoping handle of claim 1 further comprising a spring, said spring contained within said tension pin, an elongated bushing, said elongated bushing attached to said outer section, said elongated bushing defining a tension pin channel, said tension pin contained within said tension pin channel.

3. The telescoping handle of claim 2 wherein said elongated bushing comprises a dowel port, said dowel contained within said dowel port.

4. The telescoping handle of claim 3 wherein said tension pin defines a spring channel, said spring contained within said spring channel.

5. The telescoping handle of claim 1 wherein said tension pin defines a dowel tunnel, said dowel residing in said dowel tunnel.

6. The telescoping handle of claim 1 wherein said tension pin defines a depression, said inner section residing within said depression.

7. The telescoping handle of claim 1 wherein said inner section defines a series of notches, said tension pin engaging one of said notches.

8. The telescoping handle of claim 1 wherein said inner section and said outer section are each tear-drop shaped.

9. The telescoping handle of claim 8 wherein said inner section defines a tubular shape within said tear-drop shape.

10. The telescoping handle of claim 1 wherein said inner section and said outer section are each formed from aluminum.

11. A method of adjusting a telescoping handle having a tension pin proximate an outer handle section for engaging one of a series of notches of an inner handle section and a dowel engaging the tension pin, the steps comprising:

a) sliding the inner handle section into the outer handle section;

b) applying pressure to the tension pin;

c) allowing the inner handle section to move across the tension pin; and d) releasing the tension pin to engage an inner handle section notch via sliding along the dowel to prevent further movement.

12. The method of claim 11 wherein applying pressure comprises the step of applying finger pressure to the tension pin.

13. The method of claim 11 wherein allowing the inner handle section to move comprises the step of allowing the inner handle section to index in notches defined along the inner handle section.

14. The method of claim 11 wherein releasing the tension pin comprises the step of releasing the tension pin to lock the inner handle section to the outer handle section.

15. A brush having a telescoping handle comprising:

a) a brush head, said brush head comprising a series of bristles, a base, said bristles affixed to said base, a pipe, said pipe joined to said base;

b) a telescoping handle, said handle comprising an outer section, an inner section, said inner section slideably received within said outer section, said outer section joined to said pipe; and c) a tension pin, said tension pin slideably affixed to said outer section, said tension pin defining a tunnel, a dowel, said dowel contained within said tunnel to allow said tension pin to move from an open position to a closed position.

16. The brush of claim 15 wherein said inner section defines a series of notches, said tension pin engaging one of said notches.

17. The brush of claim 15 further comprising a water hose, said water hose attached to said outer section.

18. The brush of claim 15 wherein said inner section is in fluid communication with said outer section and said brush head.

19. A telescoping handle comprising:

an inner section defining a pair of passageways oriented longitudinally relative to the handle, at least one passageway defining a continuous perimeter wall to carry a fluid without leaking, and an outer section defining a passageway sized and shaped to slidably receive the inner section therein, whereby the inner section is selectively slidable relative to the outer section to allow telescoping adjustment of the handle.

20. The telescoping handle of claim 19 wherein said inner section defines a series of notches, and includes a tension pin for selectively engaging one of said notches.

* * * * *